US007045022B2

(12) United States Patent
Breslin et al.

(10) Patent No.: US 7,045,022 B2
(45) Date of Patent: May 16, 2006

(54) REMOVAL OF ADHERENT MOLTEN METAL FROM SURFACES

(75) Inventors: Michael C. Breslin, Worthington, OH (US); Andrew C. Strange, Worthington, OH (US); Michael E. Fuller, Gahanna, OH (US)

(73) Assignee: Excera Materials Group, Inc., Columbus, OH (US)

( * ) Notice: Subject to any disclaimer, the term of this patent is extended or adjusted under 35 U.S.C. 154(b) by 14 days.

(21) Appl. No.: 10/625,348

(22) Filed: Jul. 23, 2003

(65) Prior Publication Data

US 2004/0244820 A1 Dec. 9, 2004

Related U.S. Application Data

(60) Provisional application No. 60/397,929, filed on Jul. 23, 2002.

(51) Int. Cl.
*B08B 3/04* (2006.01)

(52) U.S. Cl. ..... 134/34; 134/2; 134/3; 134/16; 134/19; 134/22.1; 134/22.12; 134/22.18; 134/25.4; 134/26; 134/28; 134/30; 134/35; 134/36; 134/37; 134/41; 134/42; 266/48; 266/49; 148/194; 510/175

(58) Field of Classification Search ..... 134/2, 134/22.1, 22.12, 22.18, 16, 19, 26, 30, 34, 134/35, 36, 37, 41–42, 3, 25.4, 28; 266/48–49; 148/194; 510/175
See application file for complete search history.

(56) References Cited

U.S. PATENT DOCUMENTS

| | | | | |
|---|---|---|---|---|
| 2,491,440 | A * | 12/1949 | Boedecker et al. | 239/434.5 |
| 3,100,255 | A * | 8/1963 | Miller | 219/70 |
| 3,142,593 | A * | 7/1964 | Wrangell | 148/194 |
| 3,237,275 | A * | 3/1966 | Middleton | 407/8 |
| 3,734,476 | A * | 5/1973 | Holzman | 266/48 |
| 3,815,883 | A * | 6/1974 | Van Horn | 266/74 |
| 4,083,323 | A | 4/1978 | Rote | |
| 4,313,975 | A | 2/1982 | Mairy | |
| 4,746,534 | A | 5/1988 | Phillippi et al. | |
| 4,797,528 | A * | 1/1989 | Moore et al. | 219/70 |
| 5,120,026 | A * | 6/1992 | Bissonnette | 266/48 |
| 5,214,011 | A | 5/1993 | Breslin | |
| 5,792,281 | A * | 8/1998 | Diehl | 148/205 |
| 5,922,144 | A * | 7/1999 | Sykes | 148/194 |
| 2004/0173953 | A1 * | 9/2004 | Sykes | 266/48 |

FOREIGN PATENT DOCUMENTS

| | | | |
|---|---|---|---|
| GB | 757188 | A | 9/1956 |
| JP | 58 136000 | A | 8/1983 |
| JP | 61 204363 | A | 9/1986 |
| WO | WO2004010067 | A1 * | 1/2004 |

* cited by examiner

*Primary Examiner*—Sharidan Carrillo
(74) *Attorney, Agent, or Firm*—Calfee Halter & Griswold LLP

(57) ABSTRACT

The present invention provides a method and process for removing adherent molten metal from a surface by applying a non-wetting agent for the metal to the surface or to the adherent molten metal. The non-wetting agent may be a pressurized fluid or applied by a pressurized fluid.

28 Claims, No Drawings

REMOVAL OF ADHERENT MOLTEN METAL FROM SURFACES

CROSS REFERENCE TO RELATED APPLICATION

This application claims the benefit under 35 U.S.C. § 119(e) of U.S. Provisional Application 60/397,929 filed Jul. 23, 2002, titled REMOVAL OF ADHERENT MOLTEN METAL FROM SURFACES, which application is hereby incorporated by reference in its entirety.

BACKGROUND

The present invention generally relates to molten metal processes, and, more specifically, to removal of adherent molten metal from surfaces.

Many processes require the use of molten metal. For example, metal bodies or structures can be created by providing molten metal into a die or mold, allowing the molten metal to cool and solidify, and removing the solidified metal structure from the die. Metal/ceramic composite materials can be created by contacting a ceramic body with a molten metal. Molten metal is also used in some heat transfer processes, such as the use of liquid sodium in some nuclear reactor systems.

Aluminum is a metal that is often used in molten metal processes. During the use of molten metals, such as aluminum, some molten metal may adhere in undesirable locations requiring removal of the molten metal. For example, the temperature of a molten metal bath is often measured by placement of protected thermocouples into the bath. The protective cover for thermocouples may be made of iron, fused silica, or other materials designed to minimize reactivity with the molten metal. Upon removal of the protected thermocouple from the molten metal bath, some molten metal will adhere to the protective cover. One method to remove this liquefied metal from the thermocouple protective cover is to wipe the molten metal off with, for example, a refractory cloth of natural or synthetic fiber.

Another example of the need to remove molten metal from a surface is when creating a metal/ceramic composite part or workpiece by non-vapor phase oxidation of the molten metal by submerging a ceramic body into a molten metal bath, or otherwise contacting the body with molten metal, such as disclosed in U.S. Pat. No. 5,214,011. In this process, the molten metal becomes incorporated into the ceramic body and is retained therein. When the body is removed from the molten metal bath, there remains molten metal on the outside surfaces of the body.

This excess molten metal on the body is removed by scraping, wiping, or swabbing the molten metal, such as with refractory cloth, but these methods are time consuming and difficult to use effectively for small pieces or intricate surfaces. Further, with respect to the process described in U.S. Pat. No. 5,214,011, these techniques are inadequate, because molten metal may continue to exude from the workpiece to the body surface following the initial cleaning, thus requiring additional and continual swabbing as the part cools.

If the molten metal is allowed to remain on the body, protected thermocouple, etc., the molten metal may react with the surface to form undesirable products, damage the surface, or harden/solidify on the surface creating functional or aesthetic problems.

Surface finishing of metal structures may be conducted by processes such as grit blasting, but such processes generally are not suitable for removal of metal that has not hardened or solidified. Moreover, grit blasting will likely damage or remove some of the surface, as well as any molten metal such a process may remove.

SUMMARY OF THE INVENTION

The present invention provides a method and process for cleaning a metal, ceramic, or metal/ceramic composite material having molten metal adhering to its surface. This method includes applying a fluid, such as air, under pressure to a surface of the structure or to the adherent molten metal to remove the undesirable molten metal from the surface. The fluid is, or is a carrier for, a non-wetting agent for the metal to be removed.

The present invention includes cleaning a metal/ceramic composite material made by contacting a ceramic body with molten metal, wherein the ceramic at least partially oxidizes the molten metal to form a metal oxide ceramic component and ensuring that molten metal flows into at least part of the metal oxide ceramic component to form a metal/ceramic composite material. Then the metal/ceramic composite material is withdrawn from contact with the molten metal and a fluid under pressure is applied to a surface of the withdrawn metal/ceramic composite or to molten metal adhering to the surface of the composite to remove the adherent molten metal. The fluid is a non-wetting agent for the metal or carries a non-wetting agent for the metal and by applying the fluid to the surface or to the molten metal, the non-wetting agent is retained on the surface of the composite.

DETAILED DESCRIPTION OF THE INVENTION

The present invention is directed to cleaning a surface by removal of molten metal from the surface. While the invention is applicable to removal of any molten metal from any surface, it will be described in an exemplary manner as it relates to removal of molten aluminum from the surface of a metal/ceramic composite material.

Use of the term "metal" herein includes pure metal or metals, metal alloys, intermetallic compounds, and mixtures thereof. Use of the term "ceramic" herein is defined as inorganic, nonmetallic materials, typically crystalline in nature, and generally are compounds formed between metallic and nonmetallic elements, such as aluminum and oxygen (alumina—$Al_2O_3$), calcium and oxygen (calcia—CaO), silicon and oxygen (silica—$SiO_2$), and other analogous oxides, nitrides, borides, sulfides, and carbides, and combinations thereof. Use of the term "or" herein is the inclusive, and not the exclusive, use. See BRYAN A. GARNER, A DICTIONARY OF MODERN LEGAL USAGE 624 (2d Ed. 1995). Use of the term "non-wetting agent" indicates an agent that, when applied to a surface, results in either a contact angle between a particular molten metal and the surface of less than 105°, or a layer between the molten metal and the surface that prevents adherence of the metal to the surface after the molten metal has solidified, and includes precursors to non-wetting agents. As used herein, a "non-wetting agent precursor" is a material that when placed in contact with another material or heat becomes a non-wetting agent. For example, plastic pellets may be a non-wetting agent precursor for aluminum, because when the plastic pellets are exposed to heat, they become depositable carbon, which is a non-wetting agent for aluminum metal.

One method to form such a metal/ceramic composite is to contact a ceramic body or preform with a molten metal, such as aluminum, at a temperature greater than the melting point of the metal, but less than the melting point or softening point of the ceramic preform. Maintaining the contact at the elevated temperature for a sufficient period of time will result in at least partial oxidation of the molten metal by the ceramic to form a metal oxide ceramic component. By ensuring that at least some of the molten metal flows into contact with at least part of the metal oxide ceramic component, the preform will at least partially transform into a ceramic metal oxide body containing a metallic phase. The resulting metal/ceramic article contains at least two phases—a ceramic phase based on the metal, and a metal—one or both of which may be continuous phases. There may also be some of the original and unreacted ceramic remaining or particles, whiskers, fibers, or the like of ceramic or other material that were present in the original ceramic body and were unreacted by the metal. Dopants are sometimes added to the ceramic preformed body which may or may not affect the reaction and replacement of the preform ceramic material with the metal oxide.

In one embodiment, the ceramic body is substantially silica and the molten metal is commercial purity aluminum. A preferred molten metal is aluminum and alloys and mixtures thereof. Other metals, such as iron, nickel, cobalt, magnesium, titanium, tantalum, tungsten, yttrium, niobium, mixtures and alloys thereof, may also be used as the molten metal. The ceramic body may include, for example, silica, mullite, titania ($TiO_2$), titanium carbide (TiC), zirconia ($ZrO_2$), zirconium carbide (ZrC), zirconium nitride (ZrN), silicon nitride ($Si_3N_4$), silicon carbide (SiC), magnesium oxide (MgO), titanium carbide (TiC), aluminum nitride (AlN), aluminum oxide ($Al_2O_3$), titanium diboride ($TiB_2$), analogous sulfides, or any other ceramic in which the non-metal portion has a greater affinity for the molten metal atoms than for the metal portion of the ceramic, and compounds and mixtures thereof. A preferred ceramic body is fused silica and ceramics containing fused silica.

One manner in which this contact may be carried out is to submerge the ceramic preform into a bath of the molten metal. When the metal/ceramic composite body is removed from the molten metal bath, there will be molten metal adhering to the surface of the composite body, and, if allowed to solidify, may present functional or aesthetic problems.

Functional problems that may be presented by solidified adherent molten metal include failure to comply with manufacturing specifications or tolerances, sloughing of the solidified adherent when the material is placed into use causing interference or malfunction of equipment, failure to fit or mate with other components, etc.

Another method of creating a metal/ceramic composite material includes contacting a single surface of the ceramic preform body with a molten metal, such as by floating the preform on the surface of a molten metal bath, to allow the molten metal to react with the ceramic to form a metal oxide that replaces the ceramic in an environment containing nitrogen, argon, or other gas without the presence of air. When the metal/ceramic composite body is then removed from the molten metal, molten metal may stick to the surface of the composite body and, if allowed to solidify, may present functional or aesthetic problems.

Another example is the contact of molten metal on a surface of a ceramic preform body having a cup or related shape with an area for receiving a molten metal by pouring the molten metal into the receiving area of the preform body. Removal of this contact will again leave adherent molten metal to a surface of the preform body. Another example is placing the ceramic preform body in a container and then pouring molten metal onto the body, allowing gravity to assist with the progression of the reaction, such as by providing motivating force to move the molten metal into capillaries or other voids in the preform body. Removal of the contact between the molten metal and preform body will, again, result in adherent molten metal to at least one surface of the body.

Other methods for creating a metal/ceramic composite material are known. Removal of the contact between the molten metal and the metal/ceramic composite body often results in the adhesion of molten metal to one or more surfaces of the metal/ceramic composite body, and, if allowed to solidify, may present functional or aesthetic problems.

In each of the described methods, the ceramic preformed body essentially retains its shape during the reaction and conversion to a metal/ceramic composite body, although there may be some reduction in overall volume of the body. When the contact between the molten metal and the composite body is removed, the composite body, which may have a metallic phase, retains its shape even though its temperature is still higher than the melting point of the metal. Because the body is at this temperature, adherent metal on the surface of the composite body is still molten. This is unlike, for example, conventional die casting of molten metal where it is required that the metal part be substantially solidified prior to removing it from the die/mold or the molten metal will not retain the shape imparted by the die/mold.

To remove the molten metal adhering to the surface of the composite body, a pressurized fluid is directed at the surface or at this adherent molten metal. In a preferred embodiment, the pressurized fluid directed at the adherent molten metal is air, resulting in an air knife effect. By "air knife effect," it is meant that the pressurized and high-velocity air is utilized to accomplish removal, generally precision removal, of undesirable adherent molten metal. Preferably, substantially all of the molten metal is removed from the surface, such that the surface is substantially free of all adherent metal. It is not necessary, however, for the present invention that all of the molten metal be removed, and there may be situations in which some adherent molten metal is desired to be selectively retained on the surface.

Use of pressurized and high-velocity air removes the undesirable adherent molten metal from the composite body surface, but such removal is not always efficient and may result in merely moving the molten metal from one surface location to another surface location. Further, the high-velocity air increases the heat transfer from the molten metal to the ambient environment and leads to more rapid solidification of the adherent molten metal. One way to partially offset this effect is to use pressurized high-velocity air that is at an elevated temperature. While improvements and advantages in removal of adherent molten metal are obtained by providing air or other fluids at any temperature, including room temperature, a preferred temperature is at or near, above or below, the melting point of the molten metal. Temperatures for the specific combination of ceramic, molten metal, and non-wetting agent in a given situation may be determined without undue experimentation and depends on the choice of the user.

Fluids other than air may also be used to remove the undesirable adherent molten metal, depending upon availability, cost, reactivity, heat transfer, and other concerns relating to the specific circumstances surrounding each application. For example, any gas, such as argon, nitrogen, acetylene, methane, Or other hydrocarbon gas, etc., may be used, or liquids such as liquid zinc, lead or tin alloys, antimony or molten salts may be used. Suitable fluids will be readily apparent to one of ordinary skill in the art and it is within the spirit of the invention to use any fluid that will accomplish the removal of the undesirable adherent molten metal from the surface of the body.

Moreover, fluids directed at the surface or the adherent molten metal at any pressure or velocity will provide some degree of removal of the adherent molten metal. The specific pressure or velocity that is optimum for a particular application will depend on the molten metal used, the fluid being used, and other considerations of the particular application. Determination of effective pressures or velocities is easily accomplished by one of ordinary skill in the art for specific sets of circumstances without undue experimentation.

If the fluid is also a non-wetting agent for the metal that is molten, then deposition of this non-wetting agent on the composite body surface will improve the removal of the molten metal by preventing it from sticking to another surface location. Alternatively, the fluid may be a carrier for a non-wetting agent or a precursor to a non-wetting agent. The non-wetting agent prevents the molten metal from adhering to the surface and, thus, the metal is more easily removed before solidifying to the surface, notwithstanding the increased heat transfer provided by the pressurized, high-velocity fluid. In a preferred embodiment, carbon or graphite is entrained in the air stream and deposited on the surface of the composite body when the metal of choice is aluminum or an aluminum alloy. The deposition of carbon onto the surface prevents the aluminum from sticking to the surface.

A preferred carbon is amorphous carbon available as a carbon additive for the steel industry under the brand name Desulco® from Superior Graphite Co., Chicago Ill. Other non-wetting agents may also be utilized without departing from the spirit or scope of the present invention, depending upon availability, cost, selected metal, and other considerations. For example, other non-wetting agents for use with aluminum metal include boron nitrite (BN), barite ($BaSO_4$), cryolite ($Na_3AlF_6$), fluorite ($CaF_2$), aluminum titanate ($Al_2O_3.TiO_2$), barium carbonate ($BaCO_3$), wollastonite, calcium silicate ($CaSiO_3$), plastic pellets, mixtures of NaCl and KCl, cornmeal, flour, talc, graphite, coal, coke, and other carbon sources. Effective non-wetting agents may be determined by one of ordinary skill in the art for specific molten metals and other attendant circumstances without undue experimentation.

Another phenomenon observed with creation of a metal/ceramic composite material by the methods described above is that the molten metal inside the composite body may continue to exude from the body onto the surface of the body following cleaning while the temperature of the body is still greater than the melting temperature of the metal. Application of the non-wetting agent to the surface of the composite body prevents this exuded molten metal from adhering to the surface, eliminating the need for continually cleaning the surface of the composite body as it cools.

Articles incorporating the metal/ceramic composite material described above include those made for the automotive, electronics, aerospace, and protection industries, such as engine components, turbine components, brakes, clutches, ballistic armor, and electronic packaging material, such as heat sinks, heat spreaders, substrates, and other thermal management material.

The present invention also includes removal of molten metal from the surface of other materials brought into contact with molten metal. For example, thermocouple protection tubes are often necessary to protect thermocouples inserted into molten metal baths to obtain the temperature of the molten metal bath. The protection tube is to protect the thermocouple itself from the heat or reactivity of the molten metal. Aluminum, for example, is a highly reactive molten metal and may destroy thermocouples placed directly in a molten aluminum bath. Although thermocouple protection tubes are sometimes manufactured having some non-wetting properties, often molten metal adheres to the surface of the thermocouple protection tube after it is removed from a molten metal bath.

Application of a pressurized high-velocity fluid to the surface of the thermocouple protection tube, or directly to the adherent molten metal thereon, after its removal from the molten metal bath removes undesirable molten metal adhering to the surface of the thermocouple protection tube. If the pressurized, high-velocity fluid is also a non-wetting agent for the molten metal, or is a carrier for a non-wetting agent or a precursor to a non-wetting agent, the removal of the undesired molten metal adhering to the surface is improved, similar to that discussed above for the metal/ceramic composite body surface.

Heater immersion tubes are used to protect heating elements submerged in a molten metal bath to transfer heat to the molten metal bath. Again, direct contact of the heating element within the heater immersion tube to the molten metal bath may damage or destroy the heating element. Periodically, the heater immersion tubes must be removed from the molten metal bath, and molten metal often adheres to the their surfaces. Application of a pressurized, high-velocity fluid to the surface of the heater immersion tube, or directly to the adherent molten metal thereon, promotes removal of this undesirable molten metal from the surface of the heater immersion tube. If the fluid is a non-wetting agent, or carries a non-wetting agent or a non-wetting agent precursor, removal of the undesired adherent molten metal is improved.

Riser tubes or stalk tubes are used in the transfer of molten metal to dies for fabrication of metal parts and are generally at least partially submerged in a molten metal bath. These tubes, also, may be periodically removed from the molten metal bath, resulting in adherent molten metal. The dies themselves may need to have adherent molten metal removed therefrom.

Thermocouple protection tubes, heater immersion tubes, riser/stalk tubes, dies/molds, and other structures and surfaces for contact with molten metal are made from a variety of materials, including fused silica and other ceramics, cast iron, and ceramic/metal composites. Application of a pressurized fluid, with or without non-wetting agents or non-wetting agent precursors, may be used with any material contacted with molten metal to remove molten metal adhering to the surface when the surface is withdrawn from contact with the bulk of the molten metal.

In one embodiment, an acetylene torch may be used to remove the undesirable adherent molten metal, such as aluminum, from the surface. If the acetylene torch is set to burn with a high carbon content (i.e., a "rich" condition), then application of this stream to the surface or directly to the adherent molten metal will remove the unwanted adherent molten metal. This provides the pressurized, high-velocity fluid at an elevated temperature and the high carbon content from the increased burn of the acetylene, which is deposited on the surface to provide a non-wetting agent for aluminum to the surface.

Salts (chlorides, nitrates, etc.) or mixtures of salts, both as solids or molten liquids are expected to be effective in the present invention, depending on, for example, the metal used. If the salts solidify onto the surface, they may often be removed by application of another fluid acting as a solvent, such as water, after the surface cools. Many of these salt compounds are available commercially for the quenching, tempering, or otherwise heat treating of metals. A variety of salts (chlorides and nitrates) are available from Park Thermal International Corporation (62 Todd Road, Georgetown, Ontario Canada).

It is also expected that boron oxide, sodium tetraborate, and other low melting point glasses, as well as hydroxides such as sodium hydroxide, potassium hydroxide, and lithium hydroxide, and combinations thereof, would be effective in both their solid and molten states.

Advantageous removal of molten metal from surfaces may also be achieved by application or deposition of a non-wetting agent, such as carbon, to the surface independently of pressurized fluid. For example, if the surface is wiped, scraped, etc. with a non-wetting material or a material having non-wetting agent thereon such that the non-wetting agent is deposited on the surface, then removal of the molten metal will be achieved. For example, if the surface having adherent molten aluminum or aluminum alloy is scraped with wood, which has a high carbon content, such that some carbon is deposited on the surface, the action of scraping will remove adherent molten metal and the deposited carbon will provide non-wetting for metal that may exude onto the surface. The amount of deposition of the carbon may depend on the temperature of the surface being scraped. Another example expected to be effective is to wipe the surface having adherent molten aluminum or aluminum alloy with a refractory cloth having graphite or other powdered carbon coated thereon such that graphite or other powdered carbon is deposited on the surface during the act of wiping the surface.

While the present invention has been illustrated by the above description of embodiments, and while the embodiments have been described in some detail, it is not the intention of the Applicants to restrict or in any way limit the scope of the invention to such detail. Additional advantages and modifications will readily appear to those skilled in the art, for example, using a variety of pressurized, high-velocity fluids or different non-wetting agents. Therefore, the invention in its broader aspects is not limited to the specific details, representative apparatus and methods, and illustrative examples shown and described. Accordingly, departures may be made from such details without departing from the spirit or scope of the Applicants' general or inventive concept.

We claim:

1. A method for removing molten metal from a surface having molten metal adhering thereto, comprising applying a pressurized fluid to the adherent molten metal or to the surface such that the molten metal is removed from the surface; wherein the fluid is a non-wetting agent for the metal or carries a non-wetting agent for the metal, wherein the molten metal comprises aluminum or alloys thereof, and wherein the non-wetting agent is selected from the group consisting of boron nitride, barite, cryolite, fluorite, aluminum titanate, barium carbonate, wollastonite, calcium silicate, sodium chloride/potassium chloride mixture, flour, talc, carbon, and mixtures and combinations thereof.

2. The method of claim 1, further comprising retaining at least a portion of the non-wetting agent on the surface.

3. The method of claim 1, wherein the pressurized fluid is at a selected temperature.

4. The method of claim 1, wherein the fluid is a carrier for the non-wetting agent and is a gas selected from the group consisting of air, argon, nitrogen, hydrocarbon gas including methane and acetylene, and mixtures thereof.

5. The method of claim 1, wherein the fluid is a non-wetting agent for the metal.

6. The method of claim 1, wherein the fluid is a carrier for a non-wetting agent.

7. The method of claim 1, wherein the non-wetting agent is carbon.

8. The method of claim 1, wherein applying a pressurized fluid comprises applying the fluid from an acetylene torch to the adherent molten aluminum or to the surface.

9. The method of claim 1, wherein applying a pressurized fluid comprises applying pressurized air with entrained carbon to the molten aluminum or to the surface.

10. The method of claim 1, wherein the surface comprises thermocouple protection tubes, heater immersion tubes, riser tubes, dies/molds, engine components, turbine components, brakes, clutches, armor, electronic packaging material, thermal management material, or combinations thereof.

11. The method of claim 3, wherein the temperature of the fluid is at the melting temperature of the molten metal.

12. The method of claim 7, wherein the carbon is amorphous carbon.

13. The method of claim 9, wherein the carbon is graphite.

14. A method for removing molten metal from a surface having molten metal adhering thereto, comprising applying a pressurized fluid to the adherent molten metal or to the surface such that the molten metal is removed from the surface; wherein the fluid is a non-wetting agent for the metal or carries a non-wetting agent for the metal, wherein the fluid is a liquid selected from the group consisting of molten zinc, lead, tin, antimony, mixtures or alloys thereof, and molten salts.

15. A method for cleaning a metal/ceramic composite material that has been formed by contacting a ceramic body with a molten metal and then removing the metal/ceramic composite from the molten metal, comprising applying a pressurized fluid to a surface of the metal/ceramic composite or to molten metal adhering to the surface of the composite to remove the adherent molten metal, wherein the fluid is a non-wetting agent for the metal or carries a non-wetting agent for the metal.

16. The method of claim 15, wherein the ceramic comprises a metal or silicon portion and a non-metal portion and is selected from the group consisting of silica, mullite, titania ($TiO_2$), titanium carbide (TiC), zirconia ($ZrO_2$), zirconium carbide (ZrC), zirconium nitride (ZrN), silicon nitride ($Si_3N_4$), silicon carbide (SiC), magnesium oxide (MgO), titanium carbide (TiC), aluminum nitride (AlN), aluminum oxide ($Al_2O_3$), titanium diboride ($TiB_2$), analogous sulfides, and any other ceramic in which the non-metal portion has a greater affinity for atoms of the molten metal than for the metal or silicon portion of the ceramic, and compounds and mixtures thereof.

17. The method of claim 15, wherein the metal is selected from the group consisting of aluminum, iron, nickel, cobalt, magnesium, titanium, tantalum, tungsten, yttrium, niobium, and mixtures and alloys thereof.

18. The method of claim 15, wherein the ceramic comprises a fused silica and the metal comprises aluminum or an aluminum alloy.

19. The method of claim 18, wherein the non-wetting agent is carbon.

20. The method of claim 15, further comprising providing for continued removal of molten metal that exudes from the ceramic/metal composite material after contact of the ceramic body by the molten metal.

21. The method of claim 19, wherein applying a pressurized fluid comprises applying the fluid stream from an acetylene torch to the adherent molten aluminum or to the surface.

22. The method of claim 19, wherein applying a pressurized fluid comprises applying pressurized air with entrained graphite or another carbon form to the adherent molten aluminum or to the surface.

23. The method of claim 20, wherein continued removal of molten metal comprises retaining the non-wetting agent on the surface.

24. A method for removing molten metal from a surface having molten metal adhering thereto, comprising applying a non-wetting agent for the metal to the adherent molten metal or to the surface such that the molten metal is removed from the surface, wherein applying a non-wetting agent comprises wiping the surface with a refractory cloth coated with graphite or powdered carbon.

25. The method of claim 24, further comprising retaining the non-wetting agent on the surface.

26. A method for removing molten metal from a surface having molten metal adhering thereto, comprising applying a non-wetting agent for the metal to the adherent molten metal or to the surface such that the molten metal is removed from the surface, wherein the surface comprises a metal/ceramic composite.

27. The method of claim 26, wherein the metal/ceramic composite comprises fused silica, and the molten metal comprises aluminum alloy.

28. The method of claim 26, further comprising retaining the non-wetting agent on the surface.

* * * * *